US009561879B2

(12) United States Patent
Touchet

(10) Patent No.: US 9,561,879 B2
(45) Date of Patent: Feb. 7, 2017

(54) CONTAINER PACK

(71) Applicant: SIDEL PARTICIPATIONS, Octeville sur Mer (FR)

(72) Inventor: Cyril Touchet, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 14/375,305

(22) PCT Filed: Feb. 4, 2013

(86) PCT No.: PCT/FR2013/050233
§ 371 (c)(1),
(2) Date: Jul. 29, 2014

(87) PCT Pub. No.: WO2013/117849
PCT Pub. Date: Aug. 15, 2013

(65) Prior Publication Data

US 2014/0374298 A1 Dec. 25, 2014

(30) Foreign Application Priority Data

Feb. 6, 2012 (FR) ..... 12 51099

(51) Int. Cl.
*B65D 21/02* (2006.01)
*B65D 71/08* (2006.01)

(52) U.S. Cl.
CPC ..... *B65D 21/0202* (2013.01); *B65D 21/0231* (2013.01); *B65D 71/08* (2013.01)

(58) Field of Classification Search
CPC . B65D 21/0202; B65D 21/0231; B65D 71/08; B65D 71/063; B65D 71/70; B65D 71/066; B65B 21/245; B65B 61/02
See application file for complete search history.

(56) References Cited

U.S. PATENT DOCUMENTS 3,353,326 A 11/1967 Becker
3,425,542 A * 2/1969 Bolen ..... B65D 71/08 206/432
3,570,663 A * 3/1971 Cunningham ..... B65D 71/16 206/194
5,927,499 A 7/1999 Vesborg
(Continued)

OTHER PUBLICATIONS

PCT/FR2013/050233 International Search Report dated Apr. 5, 2013 (4 pages including English translation).

*Primary Examiner* — Anthony Stashick
*Assistant Examiner* — James Way
(74) *Attorney, Agent, or Firm* — Brinks Gilson & Lione; G. Peter Nichols

(57) ABSTRACT

The invention relates to a pack including a group of stackable containers each of which includes a body, a shoulder, a neck, and a bottom defining a recess shaped so as to receive the neck and at least part of the shoulder of an identical underlying container; and a flexible film enclosing the group of containers, said film having bottom openings aligned with each hollow recess. The film closely fits the base of the containers on a bottom contact area that annularly extends around the bottom openings; and the film further has top openings through which the necks extend, the film closely fitting the shoulders of the containers on a top contact area that annularly extends around the top openings.

9 Claims, 4 Drawing Sheets

(56) References Cited

U.S. PATENT DOCUMENTS

| | | | | |
|---|---|---|---|---|
| 5,938,011 | A * | 8/1999 | Holzapfel | B65D 71/00 206/203 |
| 7,574,843 | B2 | 8/2009 | Koster et al. | |
| 7,699,171 | B2 * | 4/2010 | Rivera | B65D 21/0231 206/508 |
| 2007/0169433 | A1 * | 7/2007 | Koster | B65B 21/245 53/398 |
| 2008/0289986 | A1 * | 11/2008 | Goto | B65D 71/08 206/432 |

* cited by examiner

FIG.1
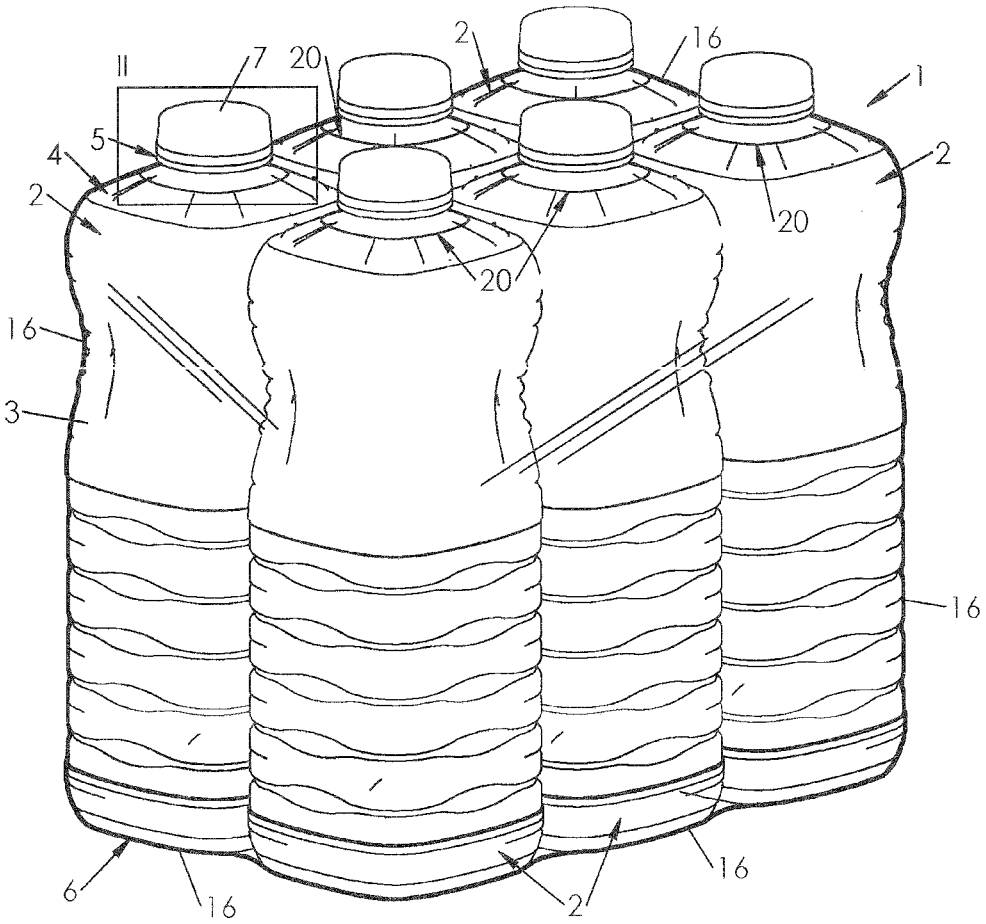
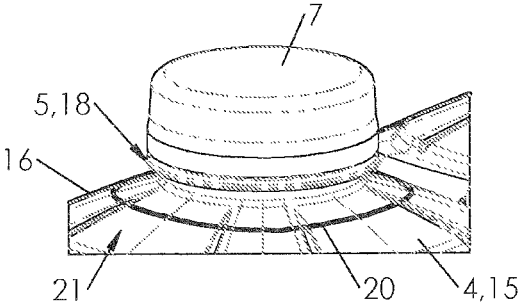
FIG.2

CONTAINER PACK

This application claims priority to International Application No. PCT/FR2013/050233 filed Feb. 4, 2013; and French Patent Application No. 1251099 filed Feb. 6, 2012, the entire contents of each are incorporated herein by reference.

BACKGROUND

The invention relates to the packaging of containers, and more particularly to the packaging of stackable containers grouped in packs.

SUMMARY

It is common to group containers, and particularly bottles containing beverages, in packs of a plurality of containers (six, eight or even twelve units), the containers being kept grouped together using a flexible film made of plastic such as polyethylene. The cohesion of the group of containers is generally ensured by means of a heat-shrinking operation of the film, which thus applies a sustained compression force on the containers.

Palletising packs is essential for the transport thereof (road, rail, sea or air). One palletising technique consists of juxtaposing the packs to form levels which are overlaid by inserting interlayer sheets (generally made of cardboard) therebetween which maintain the cohesion of the pallet while preventing the various levels from mixing.

This technique has drawbacks however.

Firstly, it does not benefit from the stackable nature of some containers, which would however help increase the packing density of the pallet while reducing the height of each layer.

Secondly, although the interlayer sheets provide some load distribution, the vertical forces applied on the underlying containers due to the weight of the containers above them are applied to the necks thereof, naturally sensitive to axial compression forces. This results in a risk of deformation of the containers at the neck thereof.

The document US 2007/0169433 relates to a packaging technique wherein each pack of containers comprises a cardboard sheet pressed against the base of the containers and film-wrapped therewith, this sheet being perforated at right angles with the bases to enable the necks of the containers from an underlying pack to pass.

However, this solution is not without drawbacks.

Indeed, according to a first example of an embodiment, illustrated in FIG. 4 of this document, the upper containers rest directly on the necks of the underlying containers. This results in a risk of deformation of the containers at the neck thereof, as mentioned above.

According to a second embodiment, illustrated in FIG. 5 of the same document, each pack rests on an underlying pack via the cardboard sheet, which engages with a protruding edge provided in the vicinity of the neck of each container. This results in a risk of deformation of the cardboard, and the return to the design in FIG. 4.

Consequently, one aim is that of providing a solution for optimising the palletising of packs of stackable containers.

Hereinafter in the description, the terms "top", "bottom", "upper part", "lower part", "upper", "lower", "above", "below", "side" or "wall" applied to a container are used considering said container to be in the upright position, i.e. when the container is a bottle with the neck or spout thereof above the other parts of the container.

For this, the invention relates to a pack comprising:

- a group of stackable containers each comprising a body, a shoulder extending from the body in the upper part of the container, a neck extending from the shoulder, and a base extending from the body in the lower part of the container, the base defining a reserve shaped to receive the neck and at least one part of the shoulder of an identical underlying container,
- a flexible film wrapping the group of containers, this film being perforated with lower openings at right angles with each hollow reserve, this pack being characterised in that:

- the film moulds the base of the containers on a lower contact area extending annularly around the lower openings,
- the film is further perforated with upper openings through which the necks extend, the film moulding the shoulders of the containers over an upper contact area extending annularly around the upper openings.

By means of these openings, it is possible to stack the packs without difficulty, the film not impeding the nesting of the containers in each other in any way. Furthermore, despite the presence, in each pack, of the openings, both in the lower part and the upper part of the containers forming the pack, the fact that the film respectively moulds the bases on a lower contact area and the shoulders on an upper contact area helps ensure satisfactory cohesion of all these containers forming the pack, such that the containers remain firmly grouped together.

Various additional features may be envisaged, alone or in combination:

- the plastic film is bioriented;
- the plastic film is heat-shrink film;
- the reserve forms a dome having a complementary profile to the shoulder of an identical container, and the lower contact area extends at least partly on the dome;
- the base has a seat defining a positioning plane, and the lower contact area encompasses this positioning plane;
- the base has a dome defining a peripheral support section, and the lower contact area at least partially encompasses this peripheral support section;
- the shoulder comprises an annular peripheral support surface, and the upper contact area encompasses at least the annular peripheral surface;
- the shoulder of the container comprises a tapered bearing surface, and the upper contact area encompasses at least partially this tapered bearing surface.

BRIEF DESCRIPTION OF THE DRAWINGS

Further aims and advantages of the invention will emerge in the light of the description of a preferred embodiment, given hereinafter with reference to the appended figures wherein:

FIG. 1 is a perspective top view showing a pack of film-wrapped containers;

FIG. 2 is detailed view showing the neck of a container from the pack, according to insert 11 in FIG. 1;

DETAILED DESCRIPTION

Figure 3:
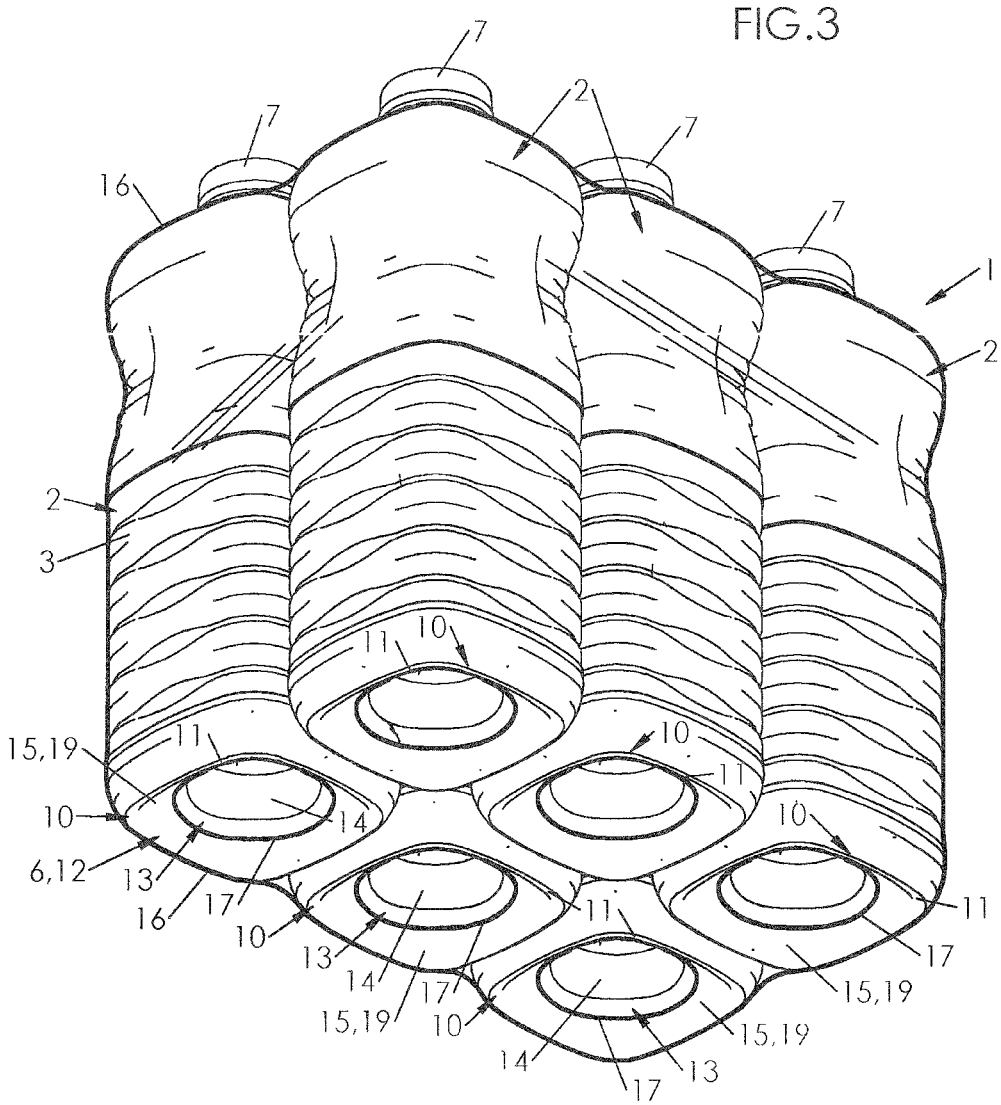
FIG. 3 is a perspective bottom view of the pack in FIG. 1.

FIGS. 1 and 2 represent a packaged pack 1, comprising a group of identical containers 2 (in this instance bottles)

intended for sale. The group comprises in the example illustrated six containers 2, but it could contain a different number thereof (for example four, eight or twelve, without these numbers being exhaustive, obviously). The containers 2 may be arranged in a plurality of rows, as in the example shown where they are organised in a known manner in two rows of three containers 2 (or, similarly, in three rows of two containers 2).

Each container 2 is of the stackable type, and comprises a body 3 extending along a main axis X, a shoulder 4 extending from the body 3 in the upper part thereof, a neck 5 defining a lip extending from the shoulder 4, and a base 6 extending from the body 3 in the lower part thereof, opposite the shoulder 4. The neck 5 is arranged, for example threaded, to enable the removable attachment of a cap 7.

The shoulder 4 forms a transition between the neck 5 and the body 3. The shoulder 4 comprises, under the neck 5, a tapered bearing surface 8 extended, at the periphery thereof, by an annular peripheral surface 9 defining a perpendicular (or substantially perpendicular) support plane with respect to the pain axis X.

Figure 4:
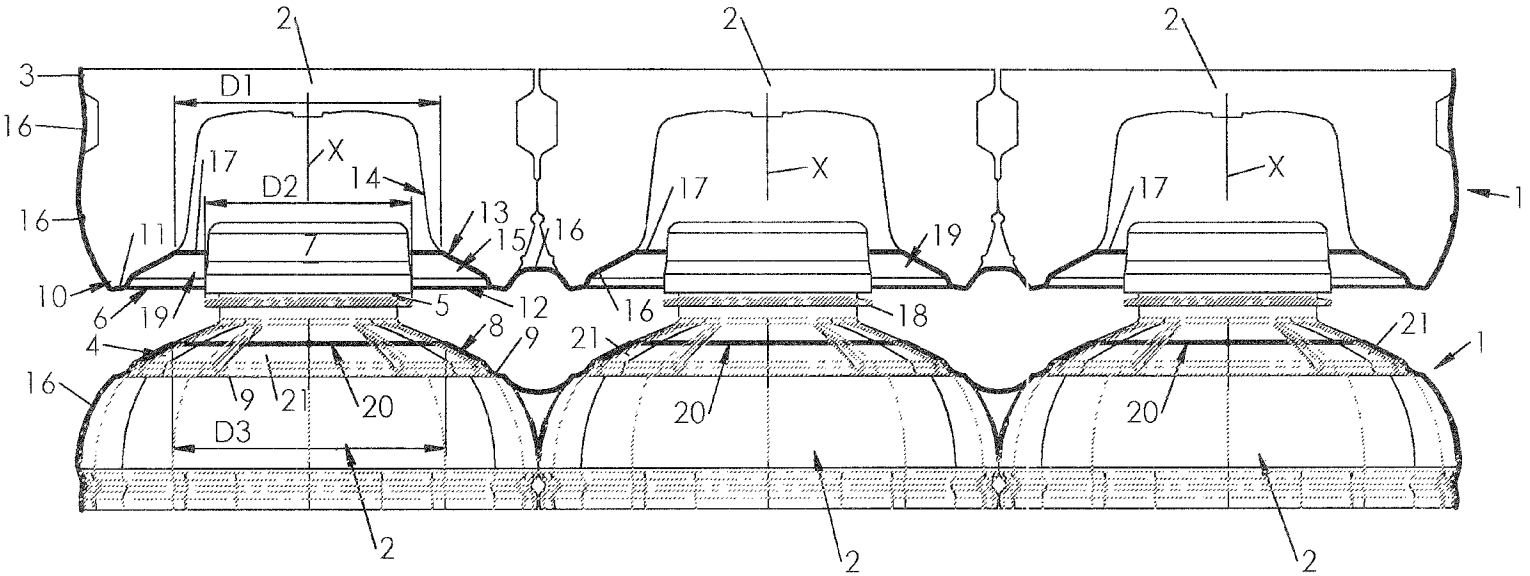
FIGS. 4 and 5 are partial sectional views illustrating the nesting of a pack on an underlying pack.
Figure 5:
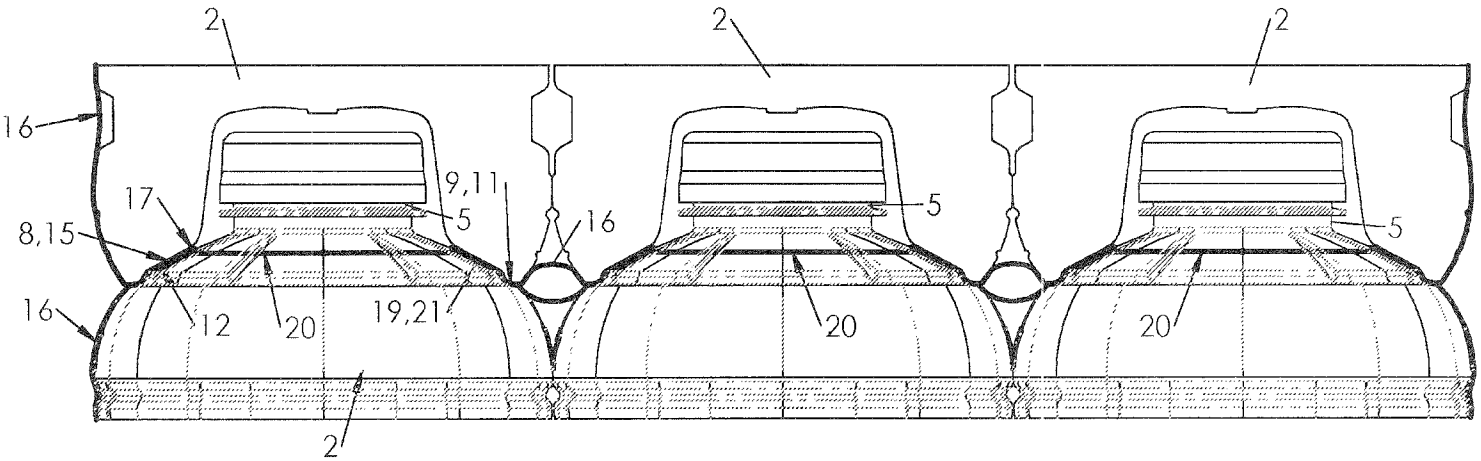

As illustrated in FIGS. 4 and 5, the base 6 is shaped to receive the upper part (comprising the shoulder 4 and the neck 5 whereon the cap 7 is screwed) of an identical underlying container 2, so as to enable stacking of the containers 2 (and thus of the packs 1).

The base 6 is partially shaped in a complementary manner to the shoulder 4, so as to enable stacking merely by inserting the shoulder 4 of the underlying container into the base 6 of the upper container 2. The base 6 thus comprises an annular seat 10 defining a continuous positioning plane 11 complementary with the peripheral support surface 9 of the shoulder 4 and extending in a perpendicular plane with respect to the main axis X.

The base 6 further defines a hollow reserve 12 shaped to receive the neck 5 and at least a part of the shoulder 4 of an identical underlying container 2. More specifically, the base 6 comprises a conical dome 13 extending from the seat 10 to the central area of the base 6. This dome 13 is in two parts and comprises a central piece 14, shaped and designed to completely encompass the neck 5 of the underlying container 2, and a peripheral support section 15, complementary to the tapered bearing surface 8 of the shoulder 4 of the underlying container 2.

As illustrated in the figures, the pack 1 is packaged using a flexible film 16 wrapping the containers 2 to keep them firmly grouped together.

As illustrated in FIG. 3, the film 16 is perforated with lower openings 17 at right angles with the hollow reserves 12 of each container 2 from the pack 1. Each opening 17 has a transverse extension D1 greater than the overall transverse extension D2 of the neck 5 of an identical underlying container 2, so as to enable the neck 5 of the underlying container to pass during stacking. The neck 5 being ordinarily rotationally symmetric, the lower opening 17 may have a circular contour, the extensions D1 and D2 then corresponding to the diameters. According to one embodiment corresponding to the most general scenario, the neck 5 is fitted with a gripping collar 18, and at this collar 18, the neck exhibits the overall transverse extension (or diameter) thereof.

As seen in FIGS. 1 and 3, the film 16 moulds the containers 2 on a part of the bodies 3 thereof, facing the outside of the pack 1. Moreover, as seen in FIG. 4, the film 16 also moulds the base 6 of each container 2 on a lower contact area 19 extending annularly around the lower opening 17. This lower contact area 19 encompasses at least the positioning plane. In the example illustrated in FIG. 4, this lower contact area 19 also encompasses the peripheral support section 15 of the dome 13, the opening 17 extending substantially at the junction between the peripheral section 15 and the central piece 14.

As can further be seen in all the figures, the film 16 is further perforated with upper openings 20 at right angles with the necks 5 of each container 2 from the pack 1, each neck 5 extending through an upper opening 20. Each upper opening 20 has a transverse extension D3 greater than the overall transverse extension D2 of the neck 5 of the container 2. The neck 5 being ordinarily rotationally symmetric, the upper opening 20 may have a circular contour, such that the transverse extension D3 corresponds to a diameter.

As seen in FIGS. 4 and 5, the film 16 moulds the shoulder 4 of each container 2 on an upper contact area 21 thereof extending annularly around the upper opening 20. The upper contact area 21 encompasses at least the annular peripheral surface 9. In the example illustrated, the upper contact area 21 also encompasses at least the periphery of the tapered bearing surface 8, the upper opening 20 extending for example approximately at mid-height thereof.

When the container 2 is stacked on an underlying container 2, as illustrated in FIG. 5, the shoulder 4 of the underlying container 2 is inserted into the hollow reserve 12 formed in the base 6 of the upper container 2.

More specifically, the positioning plane II of the upper container 2 presses against the peripheral support surface 9 of the underlying container 2, and the peripheral section 15 of the dome 13 of the upper container 2 presses against the tapered bearing surface 8 of the underlying container 2, inserting the films 16 at the lower contact area 19 of the upper container 2 and the upper contact area 21 of the underlying container 2, respectively. In view of the small thickness (in the region of a tenth of a millimeter) and the flexibility thereof, the film does not impede stacking in any way.

The lower opening 19 enables the free passage of the neck 5 of the underlying container 2 during the nesting thereof in the base 6 of the upper container 2. Any detachment of the film 16 from the peripheral section 15 of the dome 13 before stacking has no major effect: indeed, during the stacking of the packs 1, the film 16 is again pressed against the peripheral section 15 under the thrust of the tapered bearing surface 8 of the shoulder 4 of the underlying container 2.

The upper opening 20 enables the film 16 to mould the shoulder 4 on the entire periphery and thus enables the stacking of the packs 1. In the absence of this opening 20, the film 16 would form a taut cover extending between the caps 7 of the adjacent containers 2, and between the cap 7 and the body 3 of the same container 2, without moulding the shoulder 4. This would impede the nesting of the containers 2 and would not allow stacking.

The solution proposed thus facilitates the palletising of individually stackable containers 2 grouped in packs 1 wrapped in film 16, without the film 16, provided with suitably located and sized openings 17, 20, impeding the stacking of the packs 1 in any way.

Preferably, the film 16 is made of a heat-shrinkable plastic material, preferably bioriented to enable thermal isotropic shrinkage (i.e. uniform in any direction). A sufficiently resistant material (for example a polyethylene) shall be chosen so as to minimise the risks of tearing, particularly at the openings 17, 20.

The invention claimed is:

1. A pack comprising:

a group of stackable containers each comprising a body, a shoulder extending from the body in the upper part of the container, a neck extending from the shoulder, and a base extending from the body in the lower part of the container opposite the shoulder, the base defining a reserve shaped to receive the neck and at least one part of the shoulder of an identical underlying container, a flexible film wrapping the group of containers and having lower openings at right angles with each hollow reserve, wherein the film conforms to a portion of the reserved shape of the base, and the film further includes upper openings through which the necks extend, the film conforming to the shoulders of the containers over an upper contact area extending annularly around the upper openings.

2. The pack according to claim 1, wherein the flexible film is a plastic bioriented film.

3. The pack according to claim 1, wherein said reserve forms a dome having a complementary profile to the shoulder of an identical container, and the lower contact area extends at least partly on the dome.

4. The pack according to claim 1, wherein the base has a seat defining an annular positioning plane, and the lower contact area encompasses this positioning plane.

5. The pack according to claim 1, wherein the base has a dome defining a peripheral support section, and the lower contact area at least partially encompasses this peripheral support section.

6. The pack according to claim 1, wherein the shoulder of the container comprises an annular peripheral support surface, and the upper contact area encompasses at least the annular peripheral surface.

7. The pack according to claim 1, wherein the shoulder of the container comprises a tapered bearing surface, and the upper contact area encompasses at least partially the tapered bearing surface.

8. The pack according to claim 1 wherein the film is a heat-shrink film.

9. The pack according to claim 1, wherein the film is a heat-shrink film and respectively conforms to the base on a lower contact area, extending annularly around the lower openings, and to the shoulder on the upper contact area to ensure a satisfactory cohesion of all the containers forming the pack such that the containers remain firmly grouped together.

* * * * *